US007845267B2

(12) United States Patent
Potterfield et al.

(10) Patent No.: US 7,845,267 B2
(45) Date of Patent: Dec. 7, 2010

(54) ATTACHMENT MECHANISMS FOR COUPLING FIREARMS TO SUPPORTING STRUCTURES

(75) Inventors: Russell A. Potterfield, Columbia, MO (US); Tim Kinney, Columbia, MO (US); Dennis Cauley, Boonville, MO (US); Yan-Jiang Zhou, Columbia, MO (US)

(73) Assignee: Battenfield Technologies, Inc., Columbia, MO (US)

( * ) Notice: Subject to any disclaimer, the term of this patent is extended or adjusted under 35 U.S.C. 154(b) by 0 days.

(21) Appl. No.: 12/209,113

(22) Filed: Sep. 11, 2008

(65) Prior Publication Data

US 2009/0064559 A1 Mar. 12, 2009

Related U.S. Application Data

(60) Provisional application No. 60/971,507, filed on Sep. 11, 2007.

(51) Int. Cl.
*F41A 23/10* (2006.01)

(52) U.S. Cl. ..... 89/37.04; 89/40.06

(58) Field of Classification Search ..... 89/37.04, 89/40.06; 42/94

See application file for complete search history.

(56) References Cited

U.S. PATENT DOCUMENTS

| | | | | |
|---|---|---|---|---|
| 197,397 | A | 11/1877 | O'Neil | |
| 387,411 | A | 8/1888 | Gisel | |
| 399,604 | A | 3/1889 | Dufner et al. | |
| 499,315 | A | 6/1893 | Borchardt | |
| 568,543 | A | 9/1896 | Parks | |
| 668,219 | A | 2/1901 | Rock | |
| 691,912 | A | 1/1902 | McClean | |
| 718,865 | A | 1/1903 | Northcraft | |
| 778,865 | A | 1/1905 | Hyenga | |
| 789,909 | A | 5/1905 | Herold | |
| 1,033,624 | A * | 7/1912 | Schmeisser | 89/40.06 |
| 1,061,577 | A | 5/1913 | Whitney | |
| 1,088,362 | A | 2/1914 | Perkins | |
| 1,089,307 | A | 3/1914 | Benet et al. | |
| 1,121,945 | A | 12/1914 | Smith | |
| 1,145,585 | A | 7/1915 | Hebard | |

(Continued)

FOREIGN PATENT DOCUMENTS

| | | |
|---|---|---|
| DE | 838872 | 5/1952 |

(Continued)

OTHER PUBLICATIONS

U.S. Appl. No. 12/276,223, filed Nov. 21, 2008, Potterfield et al.

(Continued)

*Primary Examiner*—Stephen M Johnson
(74) *Attorney, Agent, or Firm*—Perkins Coie LLP

(57) ABSTRACT

Attachment mechanisms for attaching firearms to support structures are disclosed herein. An attachment mechanism for attaching a firearm to a support structure according to one embodiment includes a mounting member coupled to an interface member having an aperture, and a latching subassembly having an attachment portion and a latching arm. The attachment portion is configured to engage a connector fastened to the firearm through the aperture, and the latching arm lockably engages the mounting member and is coupled to the attachment portion proximate to the interface member.

24 Claims, 7 Drawing Sheets

U.S. PATENT DOCUMENTS

| | | | |
|---|---|---|---|
| 1,175,692 | A | 3/1916 | Boicourt |
| 1,187,325 | A | 6/1916 | Ivey |
| 1,195,777 | A | 8/1916 | Burtin |
| 1,250,215 | A | 12/1917 | Panos |
| 1,256,255 | A | 2/1918 | Porter |
| 1,295,688 | A | 2/1919 | Butler |
| 1,367,353 | A | 2/1921 | Craig |
| 1,488,647 | A | 4/1924 | Quinn |
| 1,639,722 | A | 8/1927 | Whitney |
| 1,693,289 | A | 11/1928 | Warren |
| 1,736,244 | A | 11/1929 | Baker |
| 1,902,040 | A | 3/1933 | Meyer |
| 1,907,181 | A | 5/1933 | Fey |
| 1,927,876 | A | 9/1933 | Meyer |
| 1,928,871 | A | 10/1933 | Swebilius |
| 2,066,218 | A | 12/1936 | Morgan |
| 2,079,510 | A | 5/1937 | King et al. |
| 2,090,930 | A | 8/1937 | Chubb |
| 2,100,514 | A | 11/1937 | Miller |
| 2,121,982 | A | 6/1938 | Pugsley |
| 2,125,353 | A | 8/1938 | Mattson |
| 2,216,766 | A | 10/1940 | Cook |
| 2,232,743 | A | 2/1941 | Swenson |
| 2,297,993 | A | 10/1942 | Tratsch |
| 2,331,372 | A | 10/1943 | Buchanan |
| 2,378,545 | A | 6/1945 | Fraser et al. |
| D147,305 | S | 8/1947 | Sloan |
| 2,432,519 | A | 12/1947 | Garand |
| 2,451,266 | A | 10/1948 | Whittemore |
| 2,455,644 | A | 12/1948 | Barnes |
| 2,476,078 | A | 7/1949 | Banks |
| 2,479,354 | A | 8/1949 | Hanson |
| 2,483,089 | A | 9/1949 | Ferguson |
| 2,484,801 | A | 10/1949 | Anderson |
| 2,508,951 | A | 5/1950 | Kazimier |
| 2,510,380 | A | 6/1950 | Clifford |
| 2,517,268 | A | 8/1950 | Wilson |
| 2,638,676 | A | 5/1953 | Callahan |
| 2,677,207 | A | 5/1954 | Stewart |
| 2,701,930 | A | 2/1955 | Dolan |
| 2,731,829 | A | 1/1956 | Wigington et al. |
| 2,740,530 | A | 4/1956 | Ponder |
| 2,753,642 | A | 7/1956 | Sullivan |
| 2,774,563 | A | 12/1956 | Pribis |
| 2,795,881 | A | 6/1957 | Bellows |
| 2,813,376 | A | 11/1957 | Middlemark |
| 2,817,233 | A | 12/1957 | Dower et al. |
| 2,821,117 | A | 1/1958 | Hultgren |
| 2,847,909 | A | 8/1958 | Kester |
| 2,867,931 | A | 1/1959 | Schreiber |
| 2,877,689 | A | 3/1959 | Pribis |
| 2,894,347 | A | 7/1959 | Woodcock |
| 2,924,881 | A | 2/1960 | Gee |
| 2,924,904 | A | 2/1960 | Amsler |
| 2,924,914 | A | 2/1960 | Garwood |
| 2,975,540 | A | 3/1961 | Lewis |
| 2,999,788 | A | 9/1961 | Morgan |
| 3,011,283 | A | 12/1961 | Lunn et al. |
| 3,012,350 | A | 12/1961 | Wold |
| 3,023,527 | A | 3/1962 | Leek et al. |
| 3,024,653 | A | 3/1962 | Broadway |
| 3,041,938 | A | 7/1962 | Seabrook |
| 3,055,655 | A | 9/1962 | Chelf |
| 3,060,612 | A | 10/1962 | Brown et al. |
| 3,112,567 | A | 12/1963 | Flanagan |
| 3,125,929 | A | 3/1964 | Peasley |
| 3,128,668 | A | 4/1964 | Dicken |
| 3,163,420 | A | 12/1964 | Braun |
| 3,175,456 | A | 3/1965 | Goodsell |
| 3,183,617 | A | 5/1965 | Ruger et al. |
| 3,206,885 | A | 9/1965 | Dye |
| 3,225,656 | A | 12/1965 | Flaherty et al. |
| D203,680 | S | 2/1966 | Benchrest |
| 3,240,103 | A | 3/1966 | Lamont |
| 3,259,986 | A | 7/1966 | Carr |
| 3,283,425 | A | 11/1966 | Boyd |
| 3,283,643 | A | 11/1966 | Mittelsteadt |
| 3,291,317 | A | 12/1966 | Bowen |
| 3,292,293 | A | 12/1966 | Chiasera et al. |
| 3,320,848 | A | 5/1967 | Ponsness |
| 3,323,246 | A | 6/1967 | Loffler |
| 3,327,422 | A | 6/1967 | Harris |
| 3,330,561 | A | 7/1967 | Kandel |
| 3,343,411 | A | 9/1967 | Lee |
| 3,353,827 | A | 11/1967 | Dun, Jr. |
| 3,370,852 | A | 2/1968 | Kandel |
| 3,406,969 | A | 10/1968 | Tisdell et al. |
| 3,423,092 | A | 1/1969 | Kandel |
| D215,311 | S | 9/1969 | Born |
| 3,486,752 | A | 12/1969 | Colvin |
| 3,499,525 | A | 3/1970 | Kanter |
| 3,510,951 | A | 5/1970 | Dow |
| 3,513,604 | A | 5/1970 | Matsunaga et al. |
| 3,550,941 | A | 12/1970 | Spiro et al. |
| 3,556,666 | A | 1/1971 | Lichenstern |
| D220,154 | S | 3/1971 | Irelan |
| 3,572,712 | A | 3/1971 | Vick |
| 3,580,127 | A | 5/1971 | Lee |
| 3,583,556 | A | 6/1971 | Wagner |
| 3,584,820 | A | 6/1971 | Butcher, Sr. |
| 3,587,193 | A | 6/1971 | Lewis |
| 3,608,225 | A | 9/1971 | Manuel |
| 3,680,266 | A | 8/1972 | Shiplov |
| 3,680,354 | A | 8/1972 | Phillips, Jr. |
| 3,711,955 | A | 1/1973 | Holt |
| 3,711,984 | A | 1/1973 | Dyer et al. |
| 3,739,515 | A | 6/1973 | Koon, Jr. |
| 3,744,292 | A | 7/1973 | Michelson |
| 3,745,875 | A | 7/1973 | Kennedy et al. |
| 3,748,950 | A | 7/1973 | Huntington |
| 3,764,219 | A | 10/1973 | Collins |
| 3,769,758 | A | 11/1973 | McDonald |
| 3,813,816 | A | 6/1974 | Funk |
| 3,815,270 | A | 6/1974 | Pachmayr |
| 3,826,559 | A | 7/1974 | Berliner et al. |
| 3,827,172 | A | 8/1974 | Howe |
| 3,842,527 | A | 10/1974 | Low |
| D233,853 | S | 12/1974 | Ferrara |
| 3,877,178 | A | 4/1975 | Campanelli |
| 3,885,357 | A | 5/1975 | Hoyt |
| 3,893,266 | A | 7/1975 | Anderson et al. |
| 3,895,803 | A | 7/1975 | Loe |
| 3,899,175 | A | 8/1975 | Loe |
| D237,106 | S | 10/1975 | Baljet et al. |
| 3,913,746 | A | 10/1975 | Burton |
| 3,914,879 | A | 10/1975 | Taylor, III et al. |
| 3,935,657 | A | 2/1976 | Wade |
| 3,947,988 | A | 4/1976 | Besaw |
| 3,949,987 | A | 4/1976 | Candor |
| 3,961,436 | A | 6/1976 | Hagen et al. |
| 3,964,613 | A | 6/1976 | Anderson, Jr. |
| 3,979,849 | A | 9/1976 | Haskins |
| 4,007,554 | A | 2/1977 | Helmstadter |
| 4,012,860 | A | 3/1977 | Auger |
| 4,021,971 | A | 5/1977 | McFadden |
| 4,026,057 | A | 5/1977 | Cady |
| 4,027,781 | A | 6/1977 | Covert |
| 4,042,242 | A | 8/1977 | Nicholls et al. |
| 4,054,288 | A | 10/1977 | Perrine, Sr. |
| 4,055,016 | A | 10/1977 | Katsenes |
| 4,072,313 | A | 2/1978 | Murso et al. |
| 4,076,247 | A | 2/1978 | Kim et al. |
| 4,120,108 | A | 10/1978 | Vickers et al. |
| 4,120,276 | A | 10/1978 | Curran |

4,122,623 A 10/1978 Stice
4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,222,305 A 9/1980 Lee
4,223,588 A 9/1980 Simpson
4,233,748 A 11/1980 Ford et al.
D257,687 S 12/1980 Bechtel
4,266,748 A 5/1981 Dalton
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,438,913 A 3/1984 Hylla
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,542,677 A 9/1985 Lee
4,548,392 A 10/1985 Rickling
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,723,472 A 2/1988 Lee
4,729,186 A 3/1988 Rieger et al.
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,815,593 A 3/1989 Brown
4,819,359 A 4/1989 Bassett
4,821,422 A 4/1989 Porter
4,821,443 A 4/1989 Bianco et al.
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell et al.
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,149,900 A 9/1992 Buck
5,173,563 A 12/1992 Gray
5,180,874 A 1/1993 Troncoso, Jr.
5,185,927 A 2/1993 Rivers
5,186,468 A 2/1993 Davies
5,188,371 A 2/1993 Edwards
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,235,764 A 8/1993 Perazzi et al.
5,237,778 A 8/1993 Baer
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,317,826 A 6/1994 Underwood
5,320,217 A 6/1994 Lenarz
5,328,029 A 7/1994 Chow et al.
5,332,185 A 7/1994 Walker, III
5,333,829 A 8/1994 Bell et al.
5,335,578 A 8/1994 Lorden et al.
5,344,012 A 9/1994 Matthews
5,347,740 A 9/1994 Rather et al.
5,358,254 A 10/1994 Yeh et al.
5,361,505 A 11/1994 Faughn
5,367,232 A 11/1994 Netherton et al.
5,370,240 A 12/1994 Hand
5,375,337 A 12/1994 Butler
5,375,377 A 12/1994 Kenton
5,377,437 A 1/1995 Underwood
5,392,553 A 2/1995 Carey 5,402,595 A 4/1995 Tamllos
5,406,733 A 4/1995 Tarlton et al.
5,414,949 A 5/1995 Peebles
D359,392 S 6/1995 Bellington
5,421,115 A 6/1995 McKay
5,433,010 A 7/1995 Bell
5,435,223 A 7/1995 Blodgett et al.
5,442,860 A 8/1995 Palmer
D362,116 S 9/1995 Bellington et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried et al.
5,501,467 A 3/1996 Kandel
D369,904 S 5/1996 Taylor
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,600,913 A 2/1997 Minneman
5,617,666 A 4/1997 Scott
5,622,344 A 4/1997 Gracie
5,628,135 A 5/1997 Cady
5,640,944 A 6/1997 Minneman
5,644,862 A 7/1997 Folmer
5,649,465 A 7/1997 Beebe
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,703,317 A 12/1997 Levilly et al.
5,711,102 A 1/1998 Plaster et al.
5,715,625 A 2/1998 West, III
D391,616 S 3/1998 Plybon
5,723,183 A 3/1998 Williams et al.
5,723,806 A 3/1998 Odom
5,737,865 A 4/1998 Brandl et al.
5,740,625 A 4/1998 Jenkins
5,758,447 A 6/1998 Venetz
5,761,954 A 6/1998 Dvorak
5,778,589 A 7/1998 Teague
5,779,527 A 7/1998 Maebashi
5,811,720 A 9/1998 Quinnell et al.
5,813,131 A 9/1998 Werre
5,815,974 A * 10/1998 Keng ..... 42/94
5,833,308 A 11/1998 Strong, III et al.
D403,176 S 12/1998 Harper
5,857,279 A 1/1999 de Oliveira Masina et al.
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,667 A 6/1999 Smilee
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,959,613 A 9/1999 Rosenberg et al.
5,970,642 A 10/1999 Martin
5,974,719 A 11/1999 Simonek
6,019,375 A 2/2000 West, Jr.
6,021,891 A 2/2000 Anderson
6,044,747 A 4/2000 Felts
6,058,641 A 5/2000 Vecqueray
6,073,381 A 6/2000 Farrar et al.
6,086,375 A 7/2000 Legros
6,110,020 A 8/2000 Rolfi
6,121,556 A 9/2000 Cole
6,254,100 B1 7/2001 Rinehart
6,260,463 B1 7/2001 Brand et al.
6,283,428 B1 9/2001 Maples et al.
6,289,622 B1 9/2001 Desch, Jr. et al.
6,293,041 B2 9/2001 Weaver
6,294,759 B1 9/2001 Dunn, Jr.
6,305,117 B1 10/2001 Hales, Sr.
6,309,476 B1 10/2001 Ravenscroft et al.
6,338,218 B1 1/2002 Hegler
6,390,294 B1 5/2002 Fiore, Jr. et al.
6,397,720 B1 6/2002 Fox et al.
6,439,515 B1 8/2002 Powers
6,517,133 B2 2/2003 Seegmiller et al.
D471,248 S 3/2003 Jacobs
6,526,687 B1 3/2003 Looney
D473,376 S 4/2003 Abate
6,546,662 B1 4/2003 Chong
6,574,899 B1 6/2003 Mostello
6,575,469 B2 6/2003 Love
6,643,973 B1 11/2003 Smith
6,663,298 B2 12/2003 Haney
6,688,031 B2 2/2004 Steele
6,736,400 B1 5/2004 Cesternino
6,813,855 B2 11/2004 Pinkley
6,814,654 B2 11/2004 Rolfi
6,854,975 B2 2/2005 Ranzinger
6,860,054 B1 3/2005 Mosher
6,862,833 B1 3/2005 Gurtner
6,871,440 B2 3/2005 Highfill et al.
6,877,266 B1 4/2005 Brownlee
6,883,263 B1 4/2005 Carrow
6,931,777 B1 8/2005 Krien
6,953,114 B2 10/2005 Wang et al.
D513,055 S 12/2005 Lahti
6,978,569 B2 12/2005 Williamson, IV et al.
D519,183 S 4/2006 Minneman
7,032,494 B2 4/2006 Wygant
D521,100 S 5/2006 Morrow
7,062,979 B2 6/2006 Day et al.
D524,541 S 7/2006 Cauley
7,086,192 B2 8/2006 Deros
7,104,398 B1 9/2006 Wisecarver
7,134,663 B1 11/2006 Lowe et al.
7,143,986 B1 12/2006 Austin et al.
7,152,355 B2 12/2006 Fitzpatrick et al.
7,152,358 B1 12/2006 LeAnna et al.
D540,904 S 4/2007 Werner
7,207,567 B1 4/2007 Brown
7,225,050 B2 5/2007 Sutula, Jr.
D553,219 S 10/2007 Potterfield
D567,895 S 4/2008 Cauley
7,357,250 B2 4/2008 Hagemann et al.
7,363,740 B2 4/2008 Kincel
7,401,431 B2 7/2008 Pierce et al.
D576,245 S 9/2008 Potterfield et al.
7,426,800 B2 9/2008 Pierce et al.
2002/0113372 A1 8/2002 Love
2004/0020097 A1 2/2004 Deros
2004/0134113 A1 7/2004 Deros et al.
2005/0000141 A1 1/2005 Cauley et al.
2005/0011101 A1 1/2005 Gooder
2005/0115137 A1 6/2005 Minneman
2005/0183319 A1 8/2005 Franks
2005/0188597 A1 9/2005 Keng et al.
2005/0242250 A1 11/2005 Keng et al.
2006/0174532 A1 8/2006 Popikow
2006/0175213 A1 8/2006 Hurt et al.
2006/0218840 A1 10/2006 Cauley
2006/0248774 A1 11/2006 Pierce et al.
2006/0248775 A1 11/2006 Wade et al.

| | | | |
|---|---|---|---|
| 2006/0254111 | A1 | 11/2006 | Giauque et al. |
| 2006/0278797 | A1 | 12/2006 | Keng et al. |
| 2007/0029733 | A1 | 2/2007 | Anderson |
| 2007/0046760 | A1 | 3/2007 | Zara |
| 2007/0068379 | A1 | 3/2007 | Sween et al. |
| 2007/0074439 | A2 | 4/2007 | Cauley et al. |
| 2007/0074440 | A2 | 4/2007 | Cauley |
| 2007/0094911 | A1 | 5/2007 | Rush et al. |
| 2007/0113460 | A1 | 5/2007 | Potterfield et al. |
| 2007/0175077 | A1 | 8/2007 | Laney et al. |
| 2007/0256346 | A1 | 11/2007 | Potterfield et al. |
| 2007/0262529 | A1 | 11/2007 | Gamez et al. |
| 2007/0266610 | A1 | 11/2007 | Coffield |
| 2007/0294929 | A1 | 12/2007 | Potterfield et al. |
| 2007/0295197 | A1 | 12/2007 | Potterfield |
| 2008/0023379 | A1 | 1/2008 | Potterfield et al. |
| 2008/0023915 | A1 | 1/2008 | Morrow et al. |
| 2008/0034636 | A1 | 2/2008 | Potterfield et al. |
| 2008/0041700 | A1 | 2/2008 | Potterfield et al. |
| 2008/0047189 | A1 | 2/2008 | Potterfield et al. |
| 2008/0054570 | A1 | 3/2008 | Potterfield et al. |
| 2008/0061509 | A1 | 3/2008 | Potterfield |
| 2008/0127815 | A1 | 6/2008 | Yale et al. |
| 2008/0168697 | A1 | 7/2008 | Potterfield et al. |
| 2008/0174071 | A1 | 7/2008 | Potterfield et al. |
| 2009/0049731 | A1 | 2/2009 | Seuk |
| 2009/0056192 | A1 | 3/2009 | Oz |
| 2009/0126250 | A1 | 5/2009 | Keng |

FOREIGN PATENT DOCUMENTS

| | | |
|---|---|---|
| EP | 0624455 | 11/1994 |
| GB | 475080 | 11/1937 |

OTHER PUBLICATIONS

U.S. Appl. No. 12/276,229, filed Nov. 21, 2008, Cauley et al.
U.S. Appl. No. 11/431,956, filed May 10, 2006, Morrow et al.
U.S. Appl. No. 11/505,784, filed Aug. 16, 2006, Cauley.
U.S. Appl. No. 11/679,832, filed Feb. 27, 2007, Cauley et al.
U.S. Appl. No. 11/739,077, filed Apr. 23, 2007, Cauley et al.
U.S. Appl. No. 11/801,341, filed Apr. 23, 2007, Potterfield et al.
U.S. Appl. No. 11/862,821, filed Sep. 27, 2007, Cesternino.
U.S. Appl. No. 11/935,381, filed Nov. 5, 2007, Potterfield.
U.S. Appl. No. 11/937,466, filed Nov. 8, 2007, Potterfield et al.
U.S. Appl. No. 12/037,336, filed Feb. 26, 2008, Potterfield.
U.S. Appl. No. 12/117,668, filed May 8, 2008, Potterfield et al.
U.S. Appl. No. 12/172,848, filed Jul. 14, 2008, Cesternino et al.
U.S. Appl. No. 12/177,032, filed Jul. 21, 2008, Potterfield et al.
"American Rifleman: What to do about recoil," LookSmart, http://www.findarticles.com/p/articles/mi_qa3623/is_199907/ai_n8861959/print, pp. 1-4 [Internet accessed on Jan. 4, 2006].
"Cleaning Cradles: Sinclaire Cleaning Cradles," p. 21, The date on which the Sinclair Folding Cleaning Cradle was first on sale is not known, but is believed to be circa 2004.
"Decker Rifle Vise," 1 page, the date on which the Decker Rifle Vise was first on sale is not known but is believed to be circa 2004.
Amazon.com, "Eforcity Magnetic Screwdriver Set w/15 bits; Great for Celiphones, Computers; Includes: T6, TORX, Security TORX, Philips, Slotted, Spanner, Tri-Wing, Bent Pry Tool, Round AWL, Reset Pin for Game Boy Advance, Nintendo WII, DS Lite, NDS, Apple TV," 1 page [Internet accessed on Sep. 18, 2007].
Battenfeld Technologies, Inc., "Gun Vise," Tipton Gun Cleaning Supplies, Battenfeld Technologies, Inc. 2004 Catalog, p. 32, Product No. 782-731, 2 pgs.
"The Grabber and Hustler '76," MEC—Mayville Engineering Company, Inc., 2 pgs., undated.
1shop2.com "Hoppe's Gunsmith's Fully Adjustable Bench Vise," http://www.1shop2.com/outdoor_sports/Hoppe's—Gunsmith's-Fully-Adj ..., 3 pgs, the date on which The Hoppe's Gunsmith's Fully Adjustable Bench Vise was first on sale is not known, but is believed to be circa 2004.
AcuSport, Outdoor Sporting Products, 3 pgs., undated.
Battenfeld Technologies, Inc., "Steady Rest Portable Shooting Rest," 1 page [Internet accessed Jan. 25, 2006].
Birchwood Casey 2005 Catalog, 28 pages.
Birchwood Casey 2006 Catalog, pp. 5-17.
Birchwood Casey, "Dirty Bird® Splattering Targets," http://www.birchwoodcasey.com/sport/target_index.asp?categoryID=4&subcat=22, pp. 1-4 [Internet accessed Jan. 16, 2006].
Birchwood Casey, "Shoot•N•C® Targets," http://www.birchwoodcasey.com/sport/target_index.asp?categoryID=4&subcat=8, pp. 1-8 [Internet accessed Jan. 16, 2006].
Birchwood Casey, "Targets Spots®," http://www.birchwoodcasey.com/sport_index.asp?categoryID=4&subcat=12, pp. 1-2 [Internet accessed Jan. 16, 2006].
Birchwood Casey, "World of Targets®," http://www.birchwoodcasey.com/sport/target_index.asp?categoryID=4&subcat=13, pp. 1-4 [Internet accessed Jan. 16, 2006].
Brownells, Inc., "Brownells Magna-Tip Screwdriver," Brownells Catalog No. 54, 2001-2002, p. 151.
Brownells, Inc., "Brownells Magna-Tip Super-Sets," Brownells Catalog No. 54, 2001-2002, p. 153.
Brownells, Inc., Catalog No. 41, 1988-1989, 3 pgs.
Brownells, Inc., Catalog No. 47, 1994-1995, 2 pgs.
Brownells, Inc., Catalog No. 57, 2004-2005. 2 pgs.
Brownells, Inc., Sight Base Cutters, Faxed Dec. 17, 2003, 1 page.
B-Square, Pro Gunsmith Screwdriver Set, B-Square Mounts Tools Accessories Product Catalog, p. 23, date unknown.
Cabela's Master Catalog, Fall 2002, Edition II, p. 416.
Cabela's Master Catalog, Fall 2003, Late-Season Edition, p. 416.
Cabela's, "HySkore Sighting System and Cleaning Vise," The date on which the HySkore Sighting System and Cleaning Vise was first on sale is not known, but is believed to be circa Jan. 2005, however, a prototype of this product may have been shown to buyers at Cabela's circa Aug. 2004, 1 page.
Caldwell Insta-View™ 4" Targets.
Caldwell™ Shooting Supplies, Targets & Target Accessories, Instra-View™ Targets, 1 page.
Californiavarmintcallers.com—Forum, http://californiavarmintcallers.com/community/modules/newbb/viewtopic.php?topic_id=10&forum=9&PHPSESSID=074ed8c7..., pp. 1-4 [Internet accessed Jan. 16, 2006].
Champion Target, "Next Generation Paper Targets," http://www.championtarget.com/products/targets/next_generation_targets.aspx, pp. 1-3, [Internet accessed on Jan. 16, 2006].
Champion Traps & Target, 2005 Product Catalog, 12 pgs.
Ellett Brothers, Rests & Gun Vises, pp. 621-622, date unknown.
Lohman Sight Vise, 4 pages product photographs, the date on which the Lohman Site Vise was first on sale is not known, but is believed to be circa 2004.
Milek, B., "Handloading for Hunting" New Products from RCBS, Lee, Accurate Arms, Peterson's Hunting, Mar. 1985, p. 21.
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].
Lahti Company Brochure, "Rock Solid Hold," Rifle Evaluator, http://www.lathicompany.com/Forms/EvaluatorBrochure2.jpg, 2 pgs. [Internet accessed Jan. 16, 2006].
Lahti Company Brochure, "Rifle Evaluator: No Pain, No Fear, No Flinching, No Body Movement," www.lahticompany.com, 2 pgs., Undated.
Lee Precision, Inc., "The World's Fastest Handloading Press . . . Lee Progressive 1000," 1985 Catalog, pp. 1-15.
Lee Precision, Inc., "Load-All," 1 page.
Lyman, "A History of Lyman Metallic Reloading," Reloading Handbook, 46th Edition, pp. 10-31.
Lyman, "Introduction to Reloading," Reloading Handbook, 46th Edition, pp. 170-203.
Carmichael, J., "Reloading for Accuracy," Lyman Reloading Handbook, 46th Edition, pp. 68-77.
Midway USA, "Chapman 27-Piece Deluxe Screwdriver Set," Master Catalog #2 and Reference Guide, 2004, Product # 510-765, p. 440.

Midway USA, "Pachmayr Professional Screwdriver Set," Master Catalog #2 and Reference Guide, 2004, Product #776-936, p. 448.
Midway USA, "Wheeler Engineering Space-Saver Gunsmithing Screwdriver Set," Master Catalog #2 and Reference Guide, 2004, Product #297-593, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MTM Case-Gard, "Gun Maintenance Centers," http://www/mtmcase-gard.com/products/shooting/gunm.html, The date on which the MTM Gun Maintenance Center was first on sale is not known, but is believed to be circa 2004, 2 pages [Internet accessed Oct. 11, 2006].
MTM Case-Gard, "Rifle rest and pistol shooting rest," http://www/mtmcase-gard.com/products/shooting/shoo.html, The date on which the MTM Site-In-Clean was first on sale is not known, but is believed to be circa 2004, 3 pages [Internet accessed Oct. 11, 2006].
MTM Case-Gard, "MTM Shoulder-Gard Rifle Rest," Cover Photo for Rest, p. 2, date unknown.
Caldwells Insta-View 4" Targets, 1 page, date unknown [product photo].
CV-500, 3 pages, date unknown [product photos].
Dillon Precision CV-500 Cartridge Case Vibratory Cleaner, 6 pages, date unknown [product photos].
Lyman Hornady Case Tumbler, 3 pages, date unknown [product photos].
Lyman Turbo 600 Tumbler, 3 pages, date unknown [product photos].
Lyman Turbo Pro 1200 Tumbler, 2 pages, date unknown [product photos].
Auto-Flo Lyman Turbo 1200 Tumbler, 2 pages, date unknown [product photos].
RCBS Automatic Primer Tool, pp. 68-71, undated.
"Reloading Manual Number Ten for Rifle and Pistol," The Cartridge Components, SPEER Omark Industries, pp. 28-54, date unknown.
"Shotshell reloading with a GRABBER 76," MEC—Mayville Engineering Company, Inc., pp. 1-12, date unknown.
Sweeney, P "Gunsmithing: Measure Headspace," Peterson's Rifleshooter, http://www.rifleshootermag.com/gunsmithing/headspace_0612/, 4 pages [Internet Accessed Dec. 11, 2004].
Tenex Precision Co., "Recoil A-Rest-R," 4 pages, date unknown [product photos].
"Plano Shooters Case, Brown Camo," The Sportman's Guide, http://www.sportmansguide.com/cb/cb.asp?a=148225, The date on which the Plano Shooters Case was first on sale is not known but is believed to be circa 2004, 3 pages [Internet accessed on Oct. 11, 2006].
Precision Shooting, Inc., Bald Eagle Front Rest, The Accurate Rifle, vol. 6, Issue No. 4, May 2003, p. 47.
Sinclair International, Sinclair Shooting Rests, Products for the Precision Shooter, 2002, Issue No. 2002-B pp. 76-78.
Device manufactured by Shooter's Ridge, a division of ATK, and available at least by late 2005, 1 page.
"Uncle Bud's Udder Bag," http:www.unclebudscss.com/pages/Udder%20Bags.html, 2 pgs. [Internet accessed on Feb. 14, 2006].
"Uncle Bud's Bull Bags," http:www.unclebudscss.com/pages/Bulls%20bags.html, 2 pgs. [Internet accessed on Feb. 14, 2006].
Millett, "BenchMaster Shooting Rests," 1 page, Undated.
Protektor Model, "The Original Leather Rifle and Pistol Rest," http://www.protektormodel.com/, 12 pages [Internet accessed on Feb. 14, 2006].
Edgewood Shooting Bags Catalog, http://www.edgebag.com/catalog.php, 7 pages [Internet accessed on Feb. 14, 2006].
Canadian Camo, "Gun Rest," http://media5.magma.ca/www.canadiancamo.com/catalog/product_info.php?products_id=..., 2 pages [Internet accessed on Feb. 13, 2006].
Caldwell Shooting Supplies, 2006 Catalog, pp. 18, 5, 12, 14 and 15.
Cabela's, "Secure Bench Rest," http://www.cabelas.com/cabelas/en/templates/links/link.jsp;jsessionid=4F0LP0OW2HMRLLAQBBISCOF.., © 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=product&cmCat=.., © 1996-2008, 2 pages [Internet accessed on Aug. 6, 2008].
Cabela's, "Sharp Shooter Rifle Rest," http://www.cabelas.com/cabelas/en/templates/links/link.jsp?id=0005816222738a&type=product&cmCat=, © 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a&type=product&cmCat=, © 1996-2008, 2 pages [Internet accessed on Aug. 6, 2008].
Cabela's, "Sure Shot Shooting Vise/Rest," http://www.cabelas.com/cabelas/en/templates/product/standard-item.jsp?id=00348272277..., © 1996-2008, 2 pages [Internet accessed on Jul. 15, 2008].
Cabela's, "BenchBuddy® Gun Rest," http://www.cabelas.com/cabelas/en/templates/links/link.jsp?id=0005819221954a&type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product&cmCat=, © 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a&type=product&cmCat=, © 1996-2008, 2 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pages [Internet accessed on Aug. 6, 2008].
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooters Ridge Steady Point Rifle Shooting Rest and Vise," http://www.midwayusa.com/eproductpage.exe/ showproduct?saleitemid=341095&t=11082005, 2005, 4 pages [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 4 pages [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].
MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin..., 15 pages [Internet accessed on Jul. 21, 2008].
Basspro.com, "Bass Pro Shops Outdoors Online: Offering the best in Fishing, Hunting and Outdoor Products," http://www.basspro.com/webapp/wcs/stores/servlet/Product_10151_-1_10001_95064_SearchResults, 2 pages [Internet accessed on Aug. 6, 2008].
Amazon.com, "CTK® P3 Ultimate Shooting Rest," Sports & Outdoors, http://www.amazon.com/CTK%C2%AE-P3-Ultimate-Shooting-Rest/dp/..., 1 page [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin..., 1 page [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/B0.., 1 page [Internet accessed on Jul. 22, 2008].
CTK Precision, All Products, http://www.ctkprecision.com/index.asp?PageAction=VIEWCATS&Cate.., 3 pages [Internet accessed on Jul. 22, 2008].
CTK Precision, "P3 Ultimate Shooting Rest," http://www.ctkprecision.com/index.asp?PageAction=VIEWPROD&ProdOID=2, 3 pages [Internet accessed on Jul. 18, 2008].
Big Boy Gun Toys, "Shooting Rest," http://www.bigboyguntoys.com/shootingrest.htm, 1 page [Internet accessed on Jul. 18, 2008].
Boyt Harness Company, Product Catalog, http://www.boytharness.com/catalog/index.php?cPath=22, 2 pages [Internet accessed on Jul. 21, 2008].
Joe's, "Shooter's Ridge Steady Point Shooting Rest," http://www.joessport.com/product/index.jsp?productID=3155005&cp=726872&parentpag.., Item No. 3155005, 1 page [Internet accessed Jul. 17, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].
"Gun Rest—Shooting Rest—Rifle Rests," http://www.jexploreproducts.com/gunrests-shootingrests.htm, 6 pages [Internet accessed Jul. 18, 2008].
E. Arthur Brown Company, "A Shooting Rest that Really Works..," http://www.eabco.com/TargetShooting01.html, © 2007-2008, 1 page [Internet accessed Jul. 18, 2008].
MacksPW.com, "Desert Mountain Bench Master Rifle Rest," http://www.macksqw.com/Item--i-DESBM1, © 2004-2008, 1 page [Internet accessed Jul. 22, 2008].
Hyskore, "Rest—Dangerous Game Machine Rest," Hyskore Rest, Professional firearm rests, http://www.hyskore.com/rests.htm, 2 pages [Internet accessed Jul. 21, 2008].
Shooters Ridge, "Shooting Rest with Gun Vise," http://www.shootersridge.com, 1 page [Internet accessed Jul. 17, 2008].
Shooters Ridge, "Deluxe Rifle Rest," http://www.shootersridge.com, 1 page [Internet accessed Jul. 21, 2008].
Chastain, R. "Load 'em Up!" About.com: Hunting/Shooting, http://hunting.about.com/od/reloadinfo/a/aaloademup_2htm, 6 pages [Internet accessed on Aug. 31, 2007].
Harris, J. et al., "The Art and Science of Annealing," http://www.6mmbr.com/annealing.html, © 2005, 13 pages [Internet accessed on Aug. 13, 2007].
Cork Industries, Inc., "Double Bumping Coating Applications," Cork Tech TalkNews, Feb. 1997, 2 pages.
Grafix® Plastics, http://www.grafixplastics.com/plastic_film_g.asp?gclid=CK-5-_7gnY4CFRVNhgodjFhfSQ, 29 pages [Internet accessed on Aug. 30, 2007].
International Search Report and Written Opinion; International Patent Application No. PCT/US07/76440; Filed: Aug. 21, 2007; Applicant: Battenfeld Technologies, Inc.; Mailed on Sep. 30, 2008.
International Search Report and Written Opinion; International Patent Application No. PCT/US07/76587; Filed: Aug. 22, 2007; Applicant: Battenfeld Technologies, Inc.; Mailed on Jul. 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Non-Final Office Action; U.S. Appl. No. 10/865,595; Mailed on Jun. 7, 2006, 8 pages.
Final Office Action; U.S. Appl. No. 10/865,595; Mailed on Apr. 3, 2007, 10 pages.
Non-Final Office Action; U.S. Appl. No. 11/339,863; Mailed on Sep. 23, 2008, 7 pages.
Non-Final Office Action; U.S. Appl. No. 11/206,430; Mailed on May 21, 2007, 12 pages.
Final Office Action; U.S. Appl. No. 11/206,430; Mailed on Oct. 29, 2007, 13 pages.
Non-Final Office Action; U.S. Appl. No. 11/206,430; Mailed on May 14, 2008, 10 pages.
Non-Final Office Action; U.S. Appl. No. 11/271,100; Mailed on Mar. 26, 2008, 9 pages.
Final Office Action; U.S. Appl. No. 11/271,100; Mailed on Sep. 22, 2008, 8 pages.
Non-Final Office Action; U.S. Appl. No. 11/311,530; Mailed on Feb. 13, 2007, 10 pages.
Non-Final Office Action; U.S. Appl. No. 11/505,784; Mailed on Dec. 26, 2007, 14 pages.
Non-Final Office Action; U.S. Appl. No. 11/507,683; Mailed on Sep. 18, 2008, 8 pages.
Non-Final Office Action; U.S. Appl. No. 11/679,100; Mailed on Oct. 16, 2008, 11 pages.
Non-Final Office Action; U.S. Appl. No. 11/679,136; Mailed on Aug. 18, 2008, 6 pages.
Non-Final Office Action; U.S. Appl. No. 11/679,136; Mailed on Aug. 28, 2008, 8 pages.
Non-Final Office Action; U.S. Appl. No. 11/844,980; Mailed on Aug. 21, 2008, 8 pages.
Non-Final Office Action; U.S. Appl. No. 11/846,408; Mailed on Aug. 18, 2008, 8 pages.
U.S. Appl. No. 12/476,041, filed Jun. 1, 2008, Cauley.
Final Office Action; U.S. Appl. No. 11/679,100; Mailed on Aug. 3, 2009, 9 pages.
Final Office Action; U.S. Appl. No. 11/679,136; Mailed on Apr. 10, 2009, 22 pages.
Final Office Action; U.S. Appl. No. 11/853,763; Mailed on Jul. 13, 2009, 7 pages.
Non-Final Office Action; U.S. Appl. No. 11/679,169; Mailed on Apr. 28, 2009, 11 pages.
Non-Final Office Action; U.S. Appl. No. 11/679,832; Mailed on Aug. 28, 2009, 9 pages.
Non-Final Office Action; U.S. Appl. No. 11/853,745; Mailed on Jun. 19, 2009, 11 pages.
Non-Final Office Action; U.S. Appl. No. 12/117,668; Mailed on Aug. 13, 2009, 15 pages.
"Cabela's Rotary Media Separator," http://www.cabelas/en/templates/links/link.jsp;jsessionid=QYVQMKM0P0P5.., 2 pages [Internet accessed Apr. 24, 2007].
Brass Cleaning Kits, http://www.berrysmfg.com/81.php, 1 page [Internet accessed Apr. 24, 2007].
Final Office Action; U.S. Appl. No. 11/206,430; Mailed on Nov. 24, 2008, 28 pages.
Final Office Action; U.S. Appl. No. 11/339,863; Mailed on Mar. 10, 2009, 22 pages.

Final Office Action; U.S. Appl. No. 11/505,784; Mailed on Dec. 19, 2008, 10 pages.
Non-Final Office Action; U.S. Appl. No. 11/418,407; Mailed on Feb. 24, 2009, 9 pages.
Non-Final Office Action; U.S. Appl. No. 11/431,956; Mailed on Mar. 2, 2009, 16 pages.
Non-Final Office Action; U.S. Appl. No. 11/607,550; Mailed on Mar. 2, 2009, 11 pages.
Non-Final Office Action; U.S. Appl. No. 11/801,341; Mailed on Jan. 13, 2009, 7 pages.
Non-Final Office Action; U.S. Appl. No. 11/853,763; Mailed on Dec. 22, 2008, 6 pages.
RCBS, "Reloading Equipment," http://www.rcbs.com/default.asp?menu=1&s1=4&s2=3&s3=25, 1 page [Internet accessed Apr. 24, 2007].
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].

* cited by examiner

ATTACHMENT MECHANISMS FOR COUPLING FIREARMS TO SUPPORTING STRUCTURES

CROSS-REFERENCE TO RELATED APPLICATION

The present application claims priority to U.S. Provisional Application Ser. No. 60/971,507, filed Sep. 11, 2007, the disclosure of which is incorporated herein by reference in its entirety.

TECHNICAL FIELD

The present disclosure is generally related to attachment mechanisms for attaching firearms to support structures, e.g., bipods.

BACKGROUND

In recent centuries, firearms have been widely used for hunting games or waging wars. To achieve precision in using firearms, monopods, bipods, tripods, gun carriages, and/or other support structures are typically attached to firearms for providing stability during firing. However, the support structures can reduce the portability of the firearms by increasing the weight and the size of the complete assemblies. Accordingly, attachment mechanisms that can enable quick attachment/detachment of the support structures to from the firearms are needed for improved operability.

DETAILED DESCRIPTION

Specific details of several embodiments of the disclosure are described below with reference to embodiments of an attachment mechanism for attaching a support structure (e.g., a bipod) to a firearm. The term "firearm" generally refers to a device that can discharge a projectile with a propellant (e.g., a combustion gas, compressed air, etc.) Examples of a firearm include rifles, machine guns, muskets, air rifles/pistols, etc. Several other embodiments may have different configurations, components, or procedures than those described in this section. A person of ordinary skill in the art, therefore, will accordingly understand that the disclosure may have other embodiments with additional elements, or the invention may have other embodiments without several of the elements shown and described below.

Figure 1:
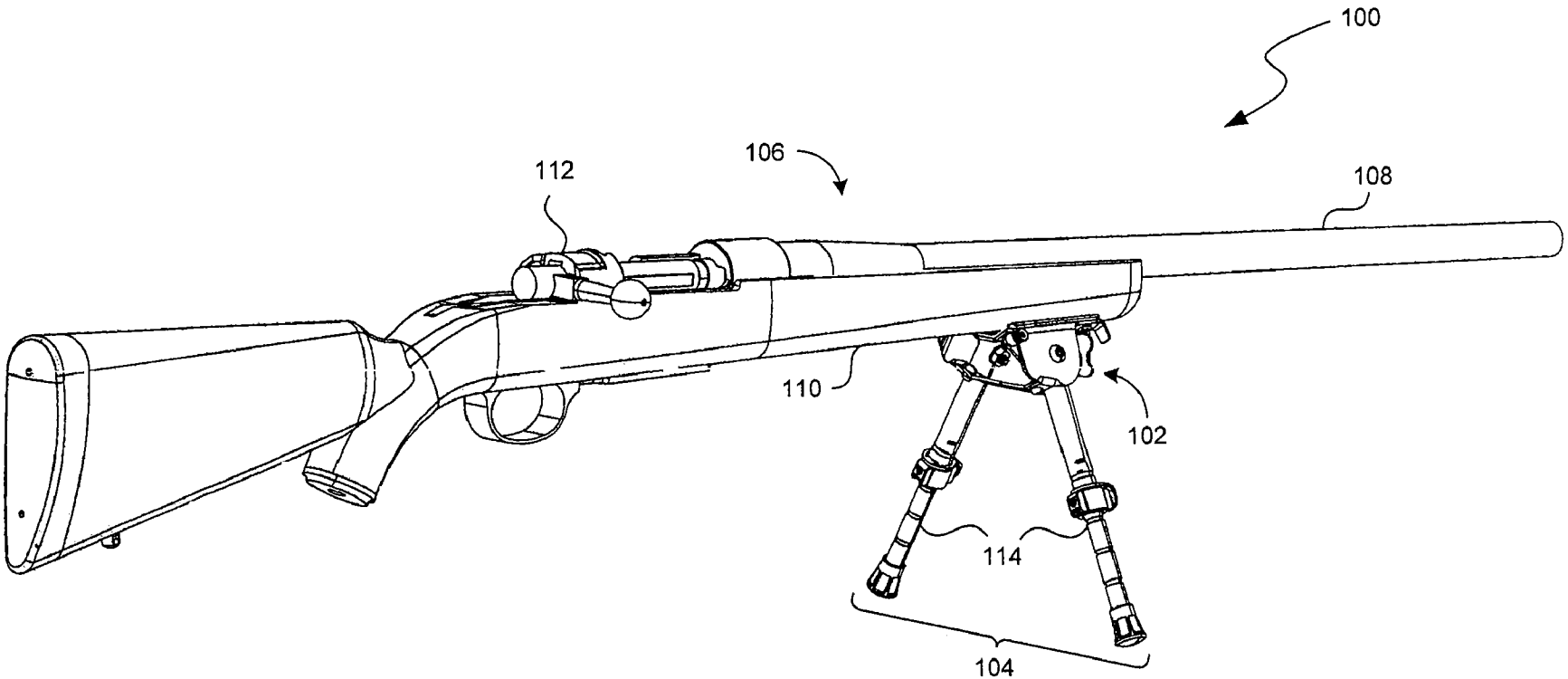
FIG. 1 is an isometric view of a firearm assembly in accordance with an embodiment of the disclosure.

FIG. 1 is an isometric view of a firearm assembly 100 in accordance with an embodiment of the disclosure. As illustrated in FIG. 1, the firearm assembly 100 can include a firearm 106, a support structure 104, and an attachment mechanism 102 connecting the support structure 104 to the firearm 106. The firearm 106 can include a barrel 108 operatively coupled to a firing mechanism 112 (e.g., a bolt-action firing mechanism), and a stock 110 at least partially supporting and/or housing the barrel 108 and the firing mechanism 112. The firearm 106 is generally illustrated in FIG. 1 as a rifle; however, in other embodiments, the firearm 106 can also be a handgun, a machine gun, and/or other types of firearm.

In the illustrated embodiment, the support structure 104 includes a bipod 114 extending from the stock 110 of the firearm 106. In certain embodiments, the bipod 114 can include two cylindrical tubes constructed from a metal, a metal alloy, a polymeric material, and/or other suitable material with sufficient strength. In other embodiments, the bipod 114 can also include springs, sleeves, pivots, and/or other features for collapsing the bipod 114 for storage and/or transport. In further embodiments, the support structure 104 can also include a monopod, a tripod, a gun carriage, and/or other support devices that can provide support to the firearm during use.

The attachment mechanism 102 can be positioned between the firearm 106 and the support structure 104. In one aspect of this embodiment, the attachment mechanism 102 can be configured to releasably attach/detach the support structure 104 to/from the firearm 106. In another aspect of this embodiment, the attachment mechanism 102 can be configured to enable a quick release of the support structure 104 from the firearm 106 for improving operability of the firearm assembly 100, as described in more detail below with reference to FIGS. 2-4B.

Even though the firearm assembly 100 is illustrated in FIG. 1 to have particular components, in certain embodiments, the firearm assembly 100 can also include shoulder straps, telescopes, external magazines, and/or other accessories for the firearm 106. In other embodiments, portions of the stock 110 and/or other components of the firearm assembly 100 can be different and/or omitted.

Figure 2:
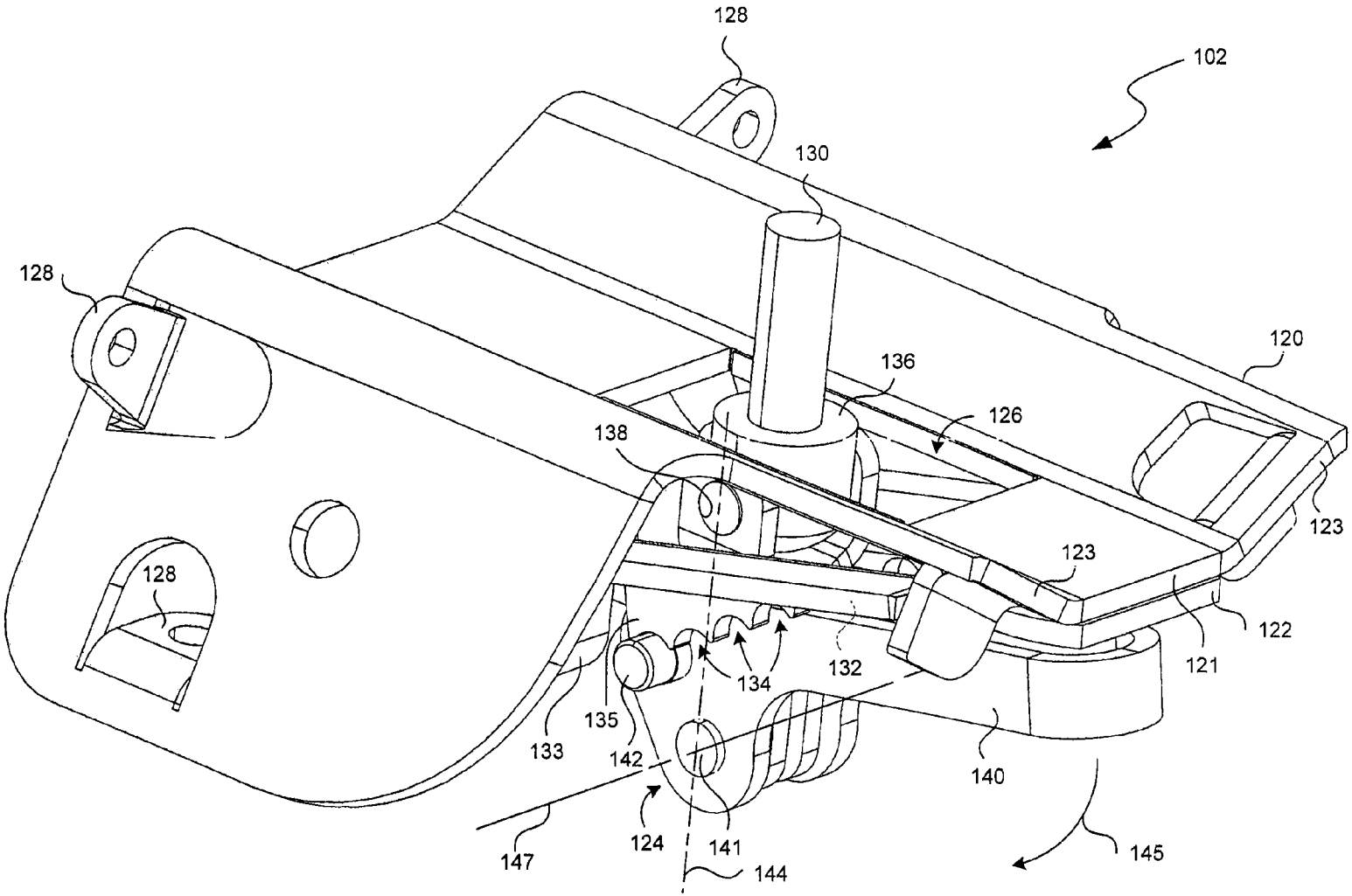
FIG. 2 is an isometric view of an embodiment of an attachment mechanism suitable for use in the firearm assembly of FIG. 1 in accordance with an embodiment of the disclosure.

FIG. 2 is an isometric view of an embodiment of the attachment mechanism 102 in FIG. 1 in accordance with an embodiment of the disclosure. As shown in FIG. 2, the attachment mechanism 102 can include an interface member 120, a mounting member 122 attached to the interface member 120, and a latching subassembly 124 movably coupled to the mounting member 122. In the illustrated embodiment, the interface member 120 and the mounting member 122 are shown as stand-alone components couplable with fasteners (e.g., bolts and nuts). However, in certain embodiments, the interface member 120 and the mounting member 122 can be formed integrally as a single component.

The interface member 120 can include a center portion 121 and two side portions 123 extending from the center portion 121. The center portion 121 and the side portions 123 can be arranged at an angle to receive and accommodate the stock 110 (FIG. 1). The center portion 121 can include an aperture 126 through which a connector 130 can extend to engage the stock 110. In one embodiment, the connector 130 can include a swivel stud. In other embodiments, the connector 130 can also include a threaded stud and/or other fasteners. The side portions 123 can also include connecting features, e.g., taps 128, for connecting to other components of the attachment mechanism 102, the support structure 104 (FIG. 1), and/or other components of the firearm assembly 100 (FIG. 1).

The mounting member 122 can include a mounting plate 132 configured to engage the center portion 121 of the interface member 120, an anchor plate 133 configured to engage the side portions 123 of the interface member 120, and a receiving plate 135 extending from the mounting plate 132. The receiving plate 135 can include notches 134 and/or other engagement features for receiving the latching subassembly 124. Embodiments of the mounting member 122 are discussed in more detail below with reference to FIG. 3.

The latching subassembly 124 can include an attachment portion 136, a latching arm 140 movably coupled to the attachment portion 136 by a coupling pin 141, and a latching pin 142 extending outwardly from the latching arm 140 and resting in one of the notches 134 of the mounting member 122. In the illustrated embodiment, the attachment portion 136 is fixedly coupled to the connector 130 with a swivel pin 138. In other embodiments, the attachment portion 136 can be coupled to the connector 130 with a screw, a bolt, a nut, and/or other fasteners. Embodiments of the latching subassembly 124 are discussed in more detailed below with reference to FIGS. 4A-B.

Referring to FIG. 1 and FIG. 2 together, the attachment mechanism 102 can securely hold the firearm 106 and the support structure 104 together during use. When assembled, the connector 130 is fixedly attached to the stock 110 of the firearm 106, and the attachment portion 136 is fixedly coupled to the connector 130. As a result, the latching subassembly 124 can force the stock 110 toward the attachment mechanism 102 via the connector 130 until the stock 110 securely rests on the interface member 120. Because different firearms may have different stock configurations (e.g., height, shape, etc.), a user can select one of the notches 134 that provides the required height between the latching pin 142 and the center portion 121 of the interface member 120 to securely engage the firearm 106.

During detachment, a user can pull the latching arm 140 clockwise (as indicated by an arrow 145) away from the mounting member 122. As the latching arm 140 pivots around the coupling pin 141, the latching pin 142 rotates toward an axis 144 that passes through the centers of the swivel pin 138 and the coupling pin 141. As a result, the rotation of the latching arm 140 pulls the stock 110 toward the interface member 120 because the distance between the swivel pin 138 and the coupling pin 141 increases. As all three pins (i.e., the swivel pin 138, the coupling pin 141, and the latching pin 142) are aligned along the axis 144, the attachment mechanism 102 exerts the maximum pulling force on the stock 110. As the user continues to pull the latching arm 140 clockwise, the latching pin 142 passes and moves away from the axis 144. As a result, the amount of pulling force exerted on the stock 110 is reduced because the distance between the swivel pin 138 and the coupling pin 141 decreases. As the user continues to pull the latching arm 140 clockwise, the pressure between the stock 110 and the interface member 120 can be reduced or even eliminated. After the pressure is at least reduced, the user can detach the attachment mechanism 102 from the stock 110 by removing the swivel pin 138.

Figure 3:
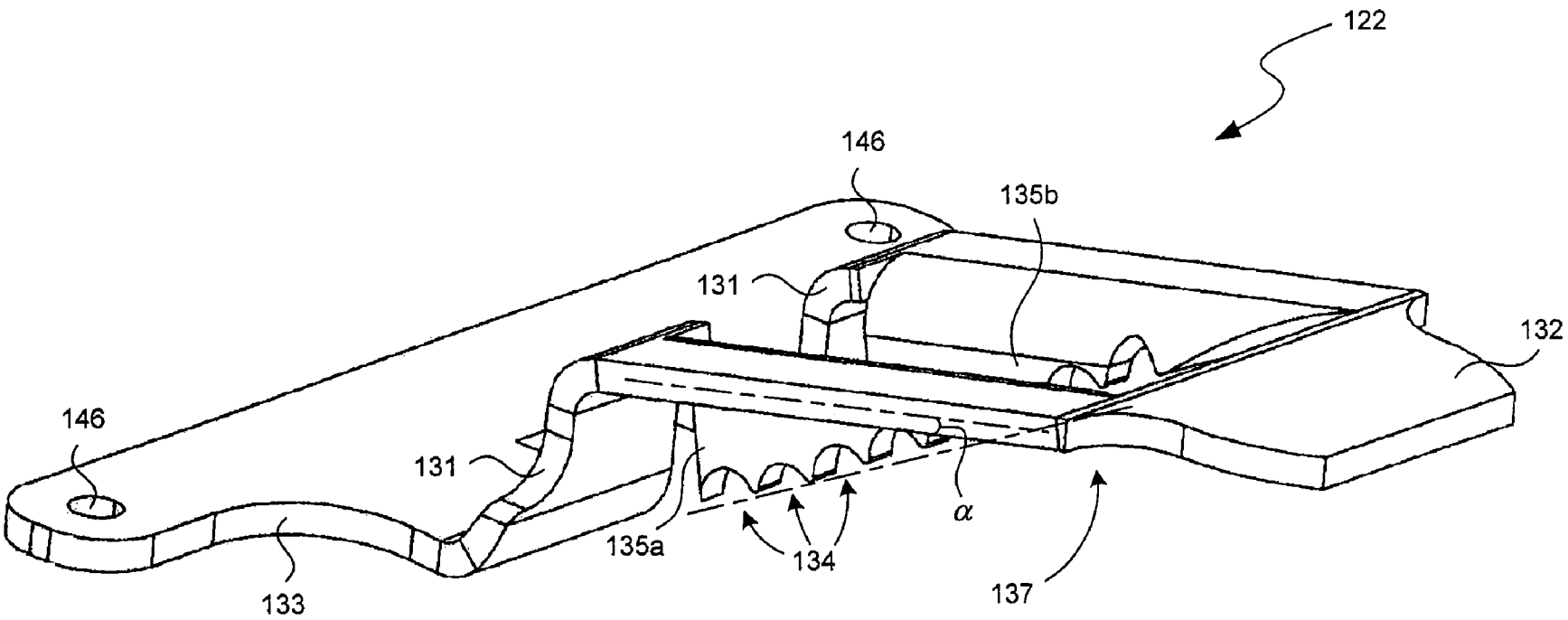
FIG. 3 is an isometric view of an embodiment of a mounting member in FIG. 2 in accordance with an embodiment of the disclosure.

FIG. 3 is an isometric view of an embodiment of the mounting member 122 in FIG. 2 in accordance with an embodiment of the disclosure. As illustrated in FIG. 3, the mounting member 122 includes the mounting plate 132, the anchor plate 133, and an intermediate portion 131 connecting the mounting plate 132 and the anchor plate 133. In the illustrated embodiment, the mounting plate 132 and the anchor plate 133 are offset from one another; however, in other embodiments, these components can be generally planar. The anchor plate 133 can include connecting features 146 (e.g., holes) for coupling to the interface member 120 (FIG. 2) and/or other components of the attachment mechanism 102.

The mounting plate 132 can also include an opening 137 configured to at least partially align with the aperture 126 (FIG. 2) of the interface member 120. The mounting member 122 also includes a first receiving plate 135*a* and a second receiving plate 135*b* having the notches 134 and extending from the mounting plate 132 along two sides of the opening 137. As shown in FIG. 3, the tops of the notches 134 form generally a line at an angle $\alpha$ with the mounting plate 132. The angle $\alpha$ can be from about 5° to about 85°, preferably from about 15° to about 60°, and more preferably from about 25° to about 45°.

Figure 4A:
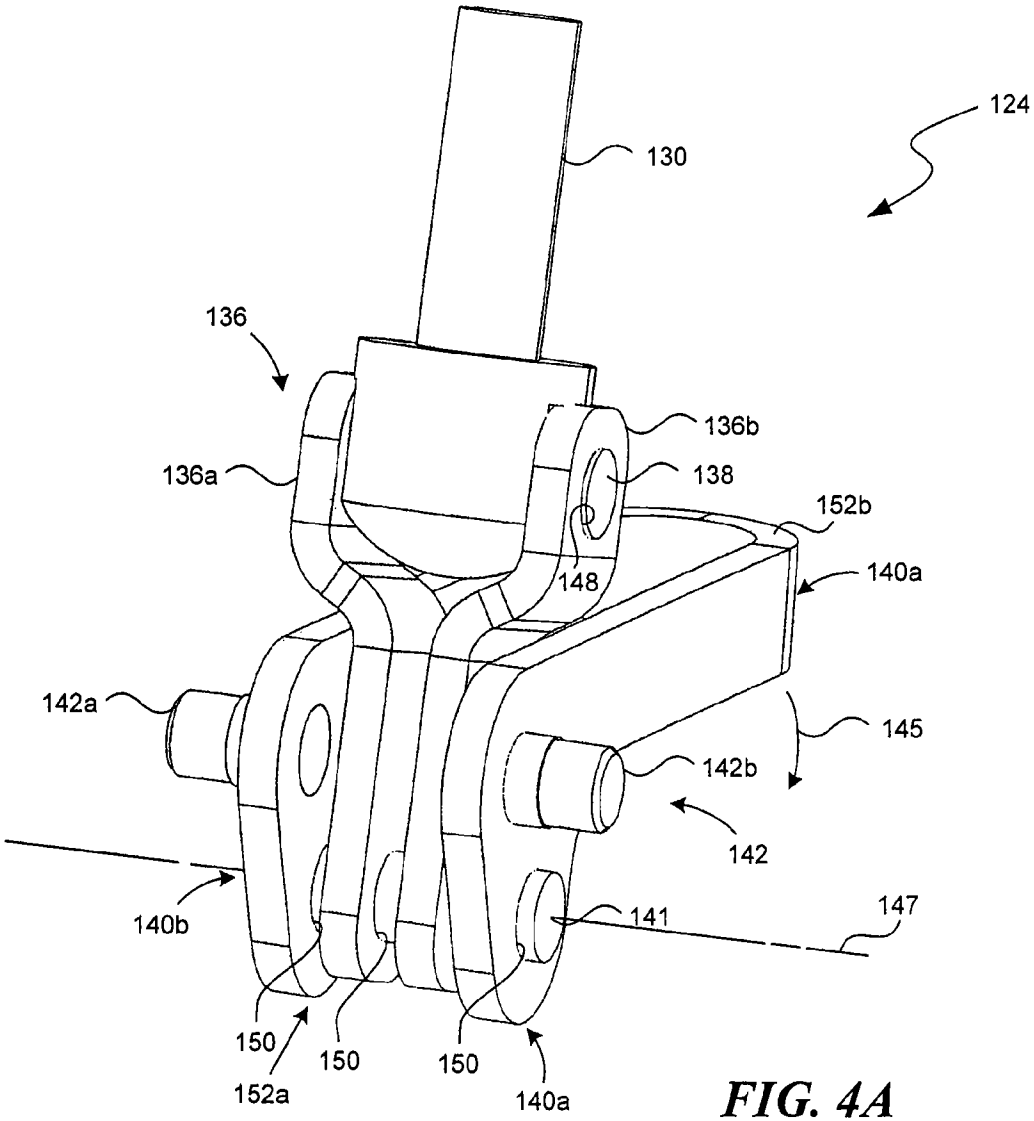
FIGS. 4A-B are isometric views of an embodiment of a latching subassembly in FIG. 2 in accordance with an embodiment of the disclosure.
Figure 4B:
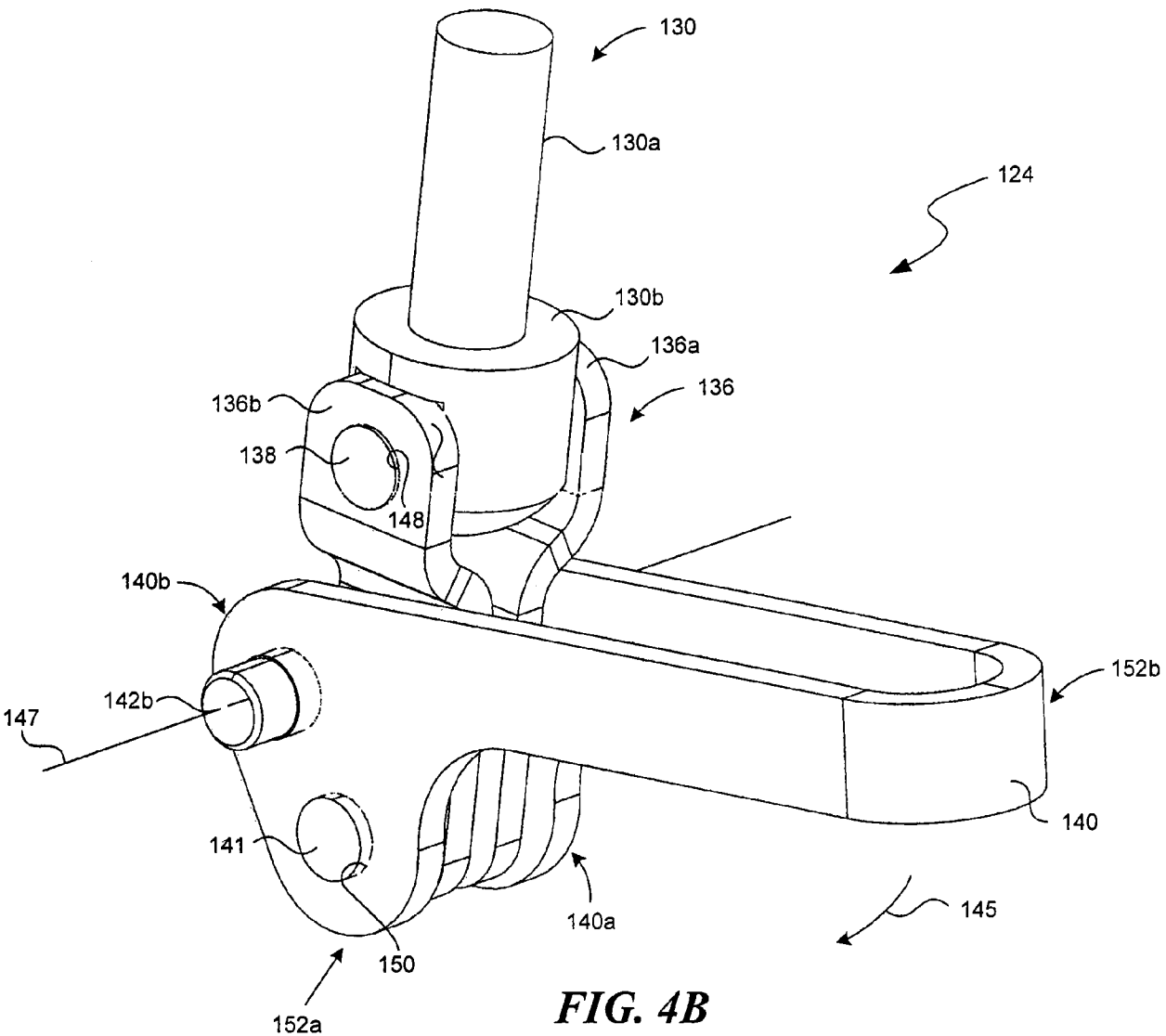

FIGS. 4A-B are isometric views of an embodiment of the latching subassembly 124 in FIG. 2 in accordance with an embodiment of the disclosure. As shown in FIGS. 4A-B, the latching subassembly 124 includes the attachment portion 136, the latching arm 140, and the coupling pin 141 pivotably coupling the attachment portion 136 and the latching arm 140 together.

The latching arm 140 includes first and second latching sections 140*a-b* spaced apart from one another and are eccentric relative to a latching axis 147 at a first end 152*a* proximate to the coupling pin 141. The latching arm 140 also includes a first latching pin 142*a* and a second latching pin 142*b* extending from the first and second latching sections 140*a-b*, respectively. The first and second latching sections 140*a-b* can be joined at a second end 152*b* spaced apart from the first end 152*a*. The attachment portion 136 can include a first attachment section 136*a* and a second attachment section 136*b* spaced apart from the first attachment section 136*a* at a distance suitable for accommodating the connector 130. Each of the first and second latching sections 140*a-b* and the first and second attachment sections 136*a-b* can include first apertures 150 that can be aligned along the latching axis 147 to allow the coupling pin 141 to extend through. The first and second attachment sections 136*a-b* can also include second apertures 148 that can be aligned to allow the swivel pin 138 to extend through. As a result, the latching arm 140 can pivot eccentrically relative to the attachment portion 136 around the latching axis 147, as indicated by the arrow 145.

Figure 5A:
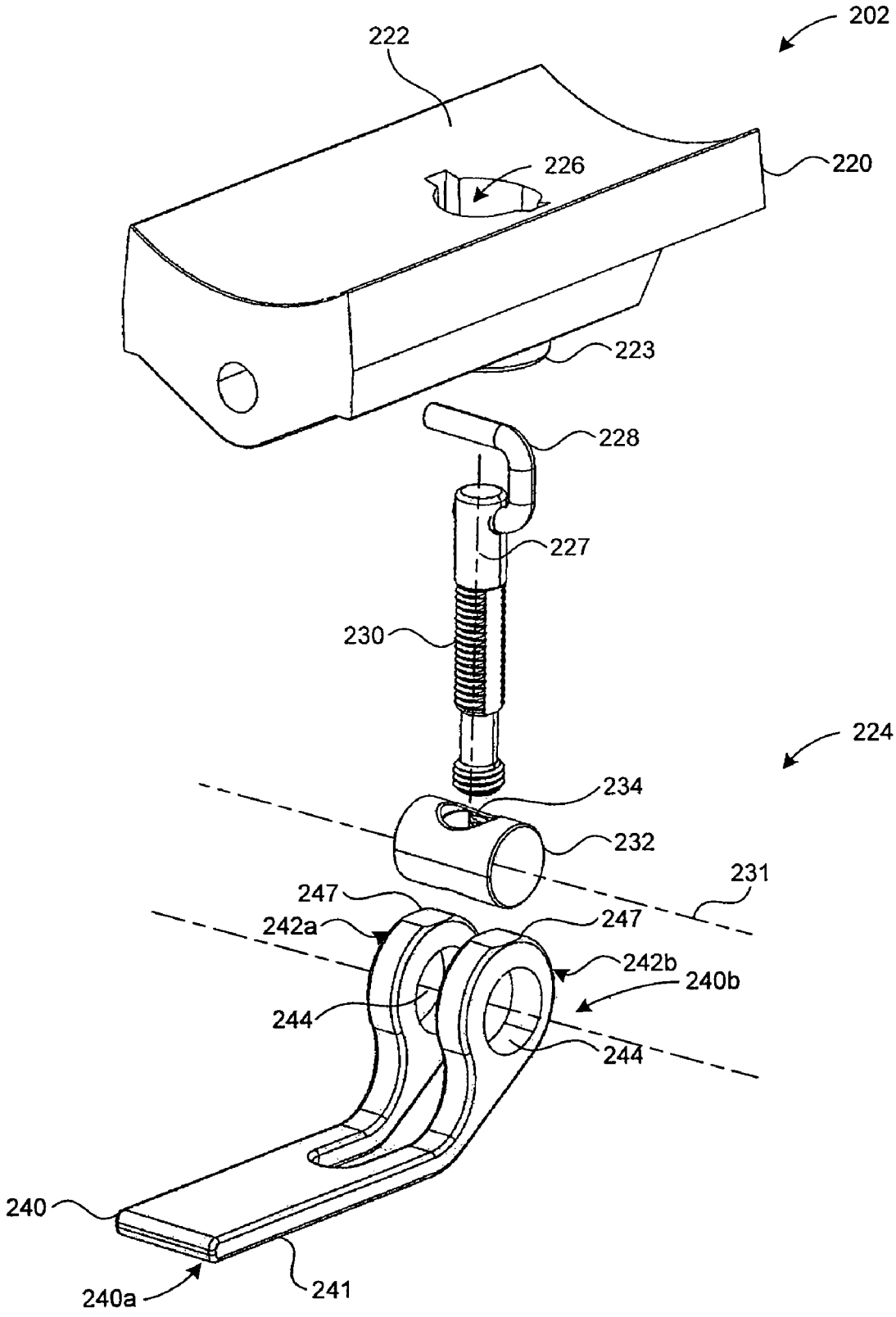
FIG. 5A is an exploded isometric view of an embodiment of an attachment mechanism suitable for use in the firearm assembly of FIG. 1 in accordance with another embodiment of the disclosure.

FIG. 5A is an exploded isometric view of an embodiment of an attachment mechanism 202 suitable for use in the firearm assembly 100 of FIG. 1 in accordance with another embodiment of the disclosure. The attachment mechanism 202 can include an interface member 220 and a latching subassembly 224 releasably coupled to the interface member 220.

The interface member 220 can include a first surface 222 that is curved to accommodate the stock 110 (FIG. 1) and a second surface 223 opposite the first surface 222 and proximate to the latching assembly 224. The interface member 220 can also include an interface aperture 226 extending from the first surface 222 to the second surface 223. As shown in FIG. 5A, The interface aperture 226 can have a generally circular cross-section with a stepped slot that extends radially outwardly. In other embodiments, the interface aperture 226 can have other cross-section configurations to accommodate the latching subassembly 224.

The latching subassembly 224 can include a attachment portion 228 fixedly or releasably attached to a threaded shaft 230. As shown in FIG. 5A, the attachment portion 228 includes a generally cylindrical bar that can engage the attachment portion 136 (FIG. 4A) by extending through the second apertures 148 (FIG. 4A). In other embodiments, the attachment portion 228 can also include a pin, a screw, and/or another fastening mechanism. In the illustrated embodiment, the threaded shaft 230 extends along a shaft axis 227 and has interrupted threads. In other embodiments, the threaded shaft 230 can have non-interrupted threads and/or other configurations.

The latching subassembly 224 can also include a bushing 232 having a threaded aperture 234 to engage the threaded shaft 230. In the illustrated embodiment, the bushing 232 has a generally cylindrical shape extending along a bushing axis 231. The threaded aperture 234 extends through the bushing 232 generally perpendicularly relative to the bushing axis 231. In other embodiments, the bushing 232 can having other configurations.

The latching subassembly 224 can further include a latching arm 240 releasably coupled to the bushing 232. The latching arm 240 includes a handle 241 at a first end 240*a* and first and second forks 242*a-b* spaced apart from one another and extending from the handle 241 toward a second end 240*b* opposite the first end 240*a*. The first and second forks 242*a-b* each include a cam structure 247 having an latching aperture 244 generally aligned along a latching axis 243 to receive the bushing 232. At least one of the cam structures 247 can be eccentric relative to the latching axis 243.

Figure 5B:
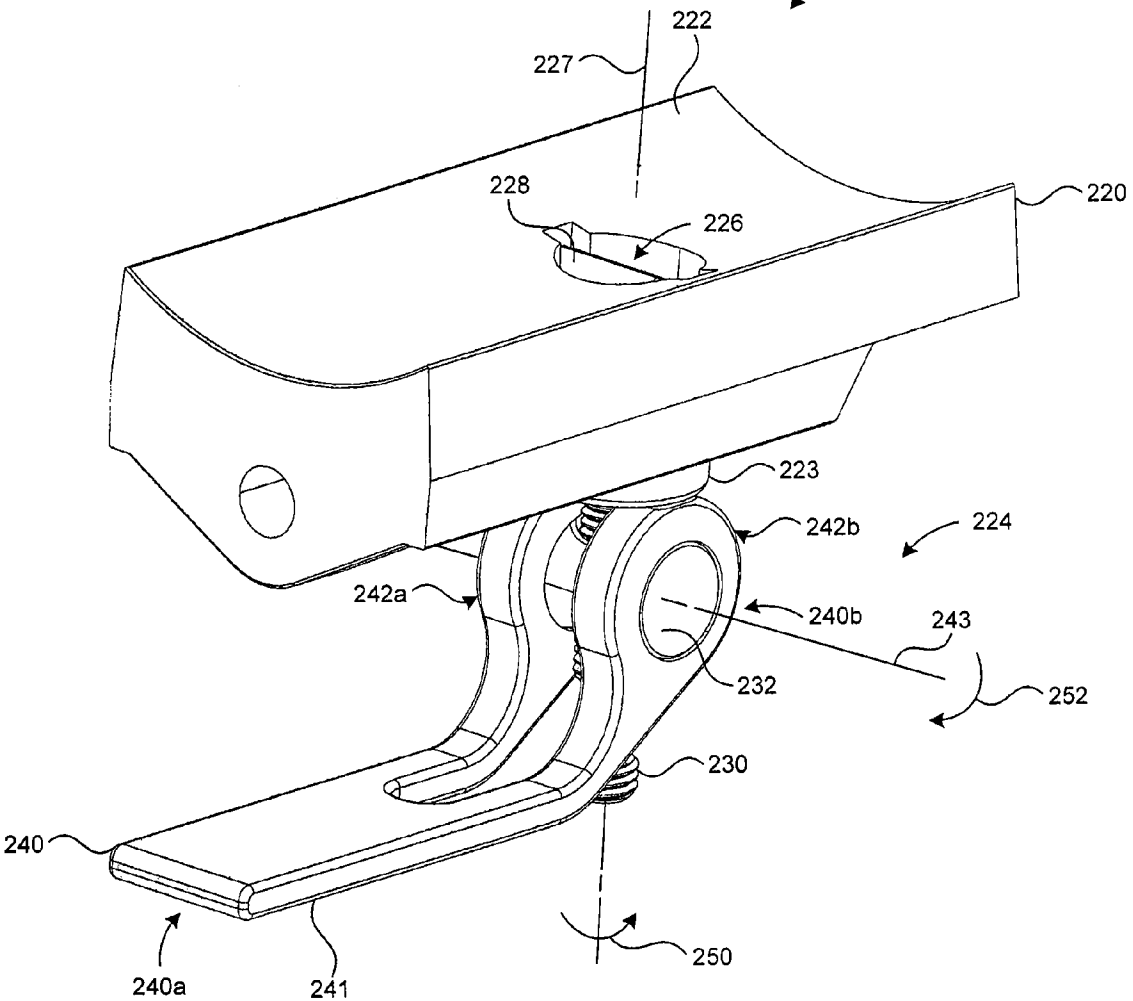
FIG. 5B is an isometric view of the attachment mechanism in FIG. 5A as assembled in accordance with another embodiment of the disclosure.

FIG. 5B is an isometric view of the attachment mechanism 202 in FIG. 5A as assembled in accordance with another embodiment of the disclosure. During assembly, the attachment portion 228 can be first engaged with the attachment portion 136 (FIG. 4A) by extending through the second apertures 148 (FIG. 4A). Then, the interface member 220 can be positioned against the stock 110 (FIG. 1) by having the threaded shaft 230 sliding through the interface aperture 226 until the attachment portion 228 rests on the stepped slot. Then, the threaded shaft 230 can extend through the bushing 232 that is received in the latching apertures 244 until the first and second forks 242*a-b* are proximate to the second surface 223 of the interface member 220. The latching arm 240 can then be rotated approximately 90° around the shaft axis 227 to engage threads of the threaded shaft 230. Then, the handle 241 can be rotated around the latching axis. As the latching arm 240 rotates, the cam structures 247 press against the second surface 223 of the interface member 220 to pull the stock 110 toward the bushing 232 in order to secure the attachment mechanism 202 to the stock 110.

In any of the embodiments discussed above, the attachment mechanisms can allows a user to attached/detach a support structure to/from a firearm without using tools and with improved attachment security over conventional techniques. According to conventional techniques, a threaded rod is typically used to couple to a swivel stud on a gun stock. A support structure (e.g., a bipod) is then attached to the stock and tightened by running a nut against the threaded rod. However, the motion of the bipod can cause the nut to come loose over time to undermine the attachment security. One conventional method to solve this problem is using tools to tighten the nut. However, such tools may not be available in the field. Embodiments of the attachment mechanisms solved this problem by using the latching arms with cam structures that can be rotated to exert resistance to the stock so that the bipod is less likely to come loose over time.

From the foregoing, it will be appreciated that specific embodiments of the invention have been described herein for purposes of illustration, but that various modifications may be made without deviating from the invention. Elements of one embodiment may be combined with other embodiments in addition to or in lieu of the elements of the other embodiments. Accordingly, the invention is not limited except as by the appended claims.

We claim:

1. An attachment mechanism for attaching a firearm to a support structure, comprising:

an interface member having an aperture;

a mounting member coupled to the interface member; and a latching subassembly having:

an attachment portion configured to engage a connector fastened to the firearm through the aperture; and a latching arm lockably engaging the mounting member and coupled to the attachment portion and proximate to the interface member, the latching arm being at least partially eccentric relative to an axis of rotation of the latching arm.

2. A firearm assembly comprising the firearm, the support structure, and the attachment mechanism of claim 1.

3. The attachment mechanism of claim 1 wherein the mounting member further comprises a receiving plate that extends perpendicularly away from the interface member and includes a plurality of engagement features configured to selectively engage the latching arm.

4. The firearm assembly of claim 3 wherein the engagement features comprise a plurality of notches in the receiving plate.

5. The attachment mechanism of claim 1 wherein the latching arm comprises a first latching arm section spaced apart from a second latching arm section, and wherein the attachment portion at least partially extends between the first and second latching arm sections.

6. The attachment mechanism of claim 1 wherein the latching subassembly further comprises:

a coupling pin pivotally coupling the latching arm to the attachment portion; and a latching pin pivotally coupling the latching arm to the mounting member.

7. The attachment mechanism of claim 6 wherein the latching pin is a first latching pin extending laterally away from the latching arm, and wherein the attachment mechanism further comprises a second latching pin extending laterally away from the latching arm in a direction opposite that of the first latching pin.

8. The attachment mechanism of claim 6 wherein the coupling pin extends through latching arm and through the attachment portion.

9. The attachment mechanism of claim 1 wherein the attachment portion comprises a first attachment section spaced apart from a second attachment section, the first and second attachment sections at least partially extending through the latching arm.

10. The attachment mechanism of claim 1, further comprising a swivel pin pivotally coupling the attachment portion to the connector, wherein the latching arm is configured to move between first and second positions, and wherein in the first position the latching arm positions the coupling pin at a first distance from the swivel pin, and in the second position the latching arm positions the coupling pin at a second distance from the swivel pin, the second distance being greater than the first distance.

11. The attachment mechanism of claim 10, wherein the swivel pin is pivotally coupled to a first end portion of the attachment portion, and wherein the coupling pin is pivotally coupled to a second end portion of the attachment portion opposite the first end portion.

12. An attachment mechanism for attaching a firearm to a support structure, the attachment mechanism comprising:

an interface member having an aperture; and a latching subassembly having an attachment portion configured to engage a connector fastened to the firearm through the aperture and a latching arm coupled to the attachment portion and proximate to the interface member, the latching arm being at least partially eccentric relative to an axis of rotation of the latching arm;

wherein the aperture is a first aperture, and wherein the interface member has a center portion with the first aperture and side portions extending away from the center portion; and wherein the attachment mechanism also includes a mounting member proximate to the interface member, the mounting member having a mounting plate with a second aperture generally aligned with the first aperture and a receiving plate extending from the mounting plate, the receiving plate having a plurality of notches, and further wherein the latching subassembly further includes a latching pin extending from the latching arm and configured to engage one of the notches on the receiving plate.

13. The attachment mechanism of claim 12 wherein the plurality of notches extend along a line at an angle with the mounting plate.

14. The attachment mechanism of claim 13 wherein the angle is from about 5° to about 85°.

15. The attachment mechanism of claim 12 wherein the attachment portion includes a first attachment section and a second attachment section spaced apart from the first attachment section.

16. The attachment mechanism of claim 12 wherein the attachment portion includes a first attachment section and a second attachment section spaced apart from the first attachment section, and wherein the first and second attachment sections each include an aperture, and further wherein the attachment mechanism also includes a swivel pin extending through the apertures and the connector.

17. The attachment mechanism of claim 12 wherein the latching arm includes a first latching section and a second latching section spaced apart from the first latching section, and wherein the attachment portion is at least partially between the first and second latching sections.

18. The attachment mechanism of claim 12 wherein the latching arm includes a first latching section and a second latching section spaced apart from the first latching section, and wherein the attachment portion includes a first attachment section and a second attachment section spaced apart from the first attachment section, and wherein the first and second attachment sections and the first and second latching sections each include an aperture, and further wherein the attachment mechanism also includes a coupling pin extending through the apertures.

19. The attachment mechanism of claim 18 wherein the latching arm is configured to pivot relative to the attachment portion around the coupling pin.

20. An attachment mechanism for attaching a firearm to a bipod, comprising:

an interface member having an aperture; and a latching subassembly having:

an attachment portion configured to engage the firearm through the aperture, wherein the attachment portion includes a first attachment arm spaced apart from a second attachment arm; and a latching portion rotatably coupled to the attachment portion, the latching portion being configured to press the interface member against the firearm when rotated relative to the attachment portion, wherein the latching portion includes a first latching arm spaced apart from a second latching arm, and wherein the first and second attachment arms at least partially extend between the first and second latching arms.

21. The attachment mechanism of claim 20 wherein the aperture is a first aperture, and wherein the attachment mechanism further includes a mounting member fixedly attached to the interface member, the mounting member having a mounting plate with a second aperture generally aligned with the first aperture and a receiving plate extending from the mounting plate, the receiving plate having a plurality of notches extend along a line at an angle with the mounting plate; and wherein the latching subassembly further includes a latching pin fixedly attached to and extending from the first latching arm, the latching pin being engaged with one of the notches of the receiving plate.

22. An attachment mechanism for attaching a firearm to a bipod, comprising:

an interface member having a center portion with a first aperture and side portions extending away from the center portion, wherein the center portion and the side portions are configured to receive the firearm, and wherein the side portions include connection features configured to couple to the bipod;

a mounting member fixedly attached to the interface member, the mounting member having a mounting plate with a second aperture generally aligned with the first aperture and a receiving plate extending from the mounting plate, the receiving plate having a plurality of notches extend along a line at an angle with the mounting plate; and a latching subassembly having an attachment portion configured to engage a swivel stud extending through the first and second apertures and fastened to the firearm, a latching arm pivotably coupled to the attachment portion, and a latching pin fixedly attached to and extending from the latching arm, the latching pin being engaged with one of the notches of the receiving plate.

23. The attachment mechanism of claim 22 wherein the latching arm includes a first latching section and a second latching section spaced apart from the first latching section, and wherein the attachment portion includes a first attachment section and a second attachment section spaced apart from the first attachment section, and wherein the first and second attachment sections and the first and second latching sections each include an aperture, and further wherein the attachment mechanism also includes a coupling pin extending through the apertures.

24. A firearm assembly comprising the firearm, a the bipod, and the attachment mechanism of claim 23.

* * * * *

UNITED STATES PATENT AND TRADEMARK OFFICE

CERTIFICATE OF CORRECTION

PATENT NO. : 7,845,267 B2
APPLICATION NO. : 12/209113
DATED : December 7, 2010
INVENTOR(S) : Russell A. Potterfield et al.

It is certified that error appears in the above-identified patent and that said Letters Patent is hereby corrected as shown below:

On page 5, in column 1, under "Other Publications", line 23, delete "Celiphones," and insert -- Cellphones, --, therefor.

In column 8, line 58, in claim 24, delete "a the" and insert --, the --, therefor.

Signed and Sealed this
Nineteenth Day of April, 2011

David J. Kappos

David J. Kappos
*Director of the United States Patent and Trademark Office*